US005988923A

United States Patent [19]

Arai

[11] Patent Number: 5,988,923

[45] Date of Patent: Nov. 23, 1999

[54] COATING CONTAINER

[75] Inventor: Hayato Arai, Abiko, Japan

[73] Assignees: Toppan Printing Co, Ltd; Taiho Industries Co., Ltd., both of Tokyo, Japan

[21] Appl. No.: 09/001,190

[22] Filed: Dec. 30, 1997

[30] Foreign Application Priority Data

Jan. 7, 1997 [JP] Japan ..... 9-000590

[51] Int. Cl.[6] ..... B43K 23/12

[52] U.S. Cl. ..... 401/262; 401/266; 401/202; 401/205; 401/261; 215/329

[58] Field of Search ..... 401/261, 262, 401/265, 266, 183, 196, 202, 205, 207; 222/546, 212; 220/203.04, 203.05, 203.06; 215/329, 377, 343, 344, 247, 249, DIG. 1

[56] References Cited

U.S. PATENT DOCUMENTS 3,074,579 1/1963 Miller ..... 215/344
5,397,194 3/1995 Yuan et al. ..... 401/266

FOREIGN PATENT DOCUMENTS 6-85258 12/1994 Japan .
1004277 9/1965 United Kingdom ..... 215/329

*Primary Examiner*—Henry J. Recla
*Assistant Examiner*—Tuan N. Nguyen
*Attorney, Agent, or Firm*—Staas & Halsey

[57] ABSTRACT

A coating container comprises a flexible container body made of plastics and capable of being depressed, an intermediate plug having a through hole, an inner cap, a coating attachment made of a felt, having a through hole, and held over the inner cap, and an outer cap having a sealing cylinder. The intermediate plug is fitted in an opening of a neck portion of the container body. The outer cap is fitted over the inner cap. The inner cap has a top plate with a through hole at a center area. An outlet cylinder having a blocked upper surface and outlet hole at a side wall is provided over the through hole. A sealing cylinder is provided outside the outlet cylinder. A circumferential wall is provided along an outer edge of the top plate. The outer cap is comprised of a circumferential wall, a top plate, and a sealing cylinder inserted into the through hole in the coating attachment and having a sealing plate at a lower side. A lower outer peripheral surface of the sealing cylinder of the outer cap is closely fitted in the sealing ring of the inner cap.

9 Claims, 3 Drawing Sheets

COATING CONTAINER

BACKGROUND OF THE INVENTION

The present invention relates to a coating container having a coating attachment formed of a felt, at its top end, which is suitable for coating a volatile liquid for preventing any oil film from being deposited on a windowpane of a vehicle for instance.

This application is based on Japanese Patent Application No.9-590, filed Jan. 7, 1997, the content of which is incorporated herein by reference.

This type of coating container is disclosed in Japanese Utility Model Publication (KOKAI) No. 6-85258.

The conventional coating container is shown in FIGS. 7 and 8. An inner cap (intermediate cover) 200 is fitted in an opening (neck opening) 111 of a neck portion of a cylindrical container body 100.

In a top plate (cover) of the inner cap 200, an outlet hole 241 is provided in order to communicate with the container body 100. A coating attachment 300 is mounted over the upper surface of the top plate of the inner cap 200 with a predetermined gap 280 therebetween. A through hole 310 is formed at that area of the coating attachment 300 over the outlet hole 241.

An outer cap (outer cover) 400 is detachably mounted to the inner cap 200 such that a rod-shaped element 440 provided at the center of its inner surface is inserted into the through hole 310 in the coating attachment 300. The top end portion of the rod-shaped element 440 acts as a plug section 441 for closing the outlet hole 241 of the inner cap 200 when the outer cap 400 is attached to the inner cap 200.

In the conventional coating container, when user wishes to coat a liquid onto an object, he or she must remove the outer cap 400 from the coating attachment 300 and depress the container body 100. However, the liquid in the container body 100 is sometimes forced straight through the through hole 310 from the outlet hole 241 and spurted suddenly toward an outside or onto the object to be coated. Thus, the user must carefully handle the container body 100.

Further, if the liquid is an acidic alcohol-based water repellent agent for an automobile windowpane which is dangerous for human eyes, for example, extra care has to be taken.

BRIEF SUMMARY OF THE INVENTION

Accordingly, it is an object of the present invention to provide a coating container which, even if it is depressed at a time of coating an object, involves no sudden spurting of a liquid, ensures positive penetration of the liquid in a coating attachment and can achieve a close seal when an outer cap is fitted over an inner cap.

According to the present invention, there is provided a coating container comprising a flexible container body made of plastics and capable of being depressed, an intermediate plug having a through hole, an inner cap, a coating attachment made of a felt, having a through hole, and held over the inner cap, and an outer cap having a sealing cylinder, wherein the intermediate plug is fitted in an opening of a neck portion of the container body, the outer cap is fitted over the inner cap, the inner cap has a top plate with a through hole at a center area, an outlet cylinder having a blocked upper surface and outlet hole at a side wall is provided over the through hole, a sealing cylinder is provided outside the outlet cylinder, a circumferential wall is provided along an outer edge of the top plate, the outer cap is comprised of a circumferential wall, a top plate, and a sealing cylinder inserted into the through hole in the coating attachment and having a sealing plate at a lower side, and a lower outer peripheral surface of the sealing cylinder of the outer cap is closely fitted in the sealing ring of the inner cap.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

A preferred embodiment of a coating container according to the present invention will now be described with reference to the accompanying drawings.

Figure 1:
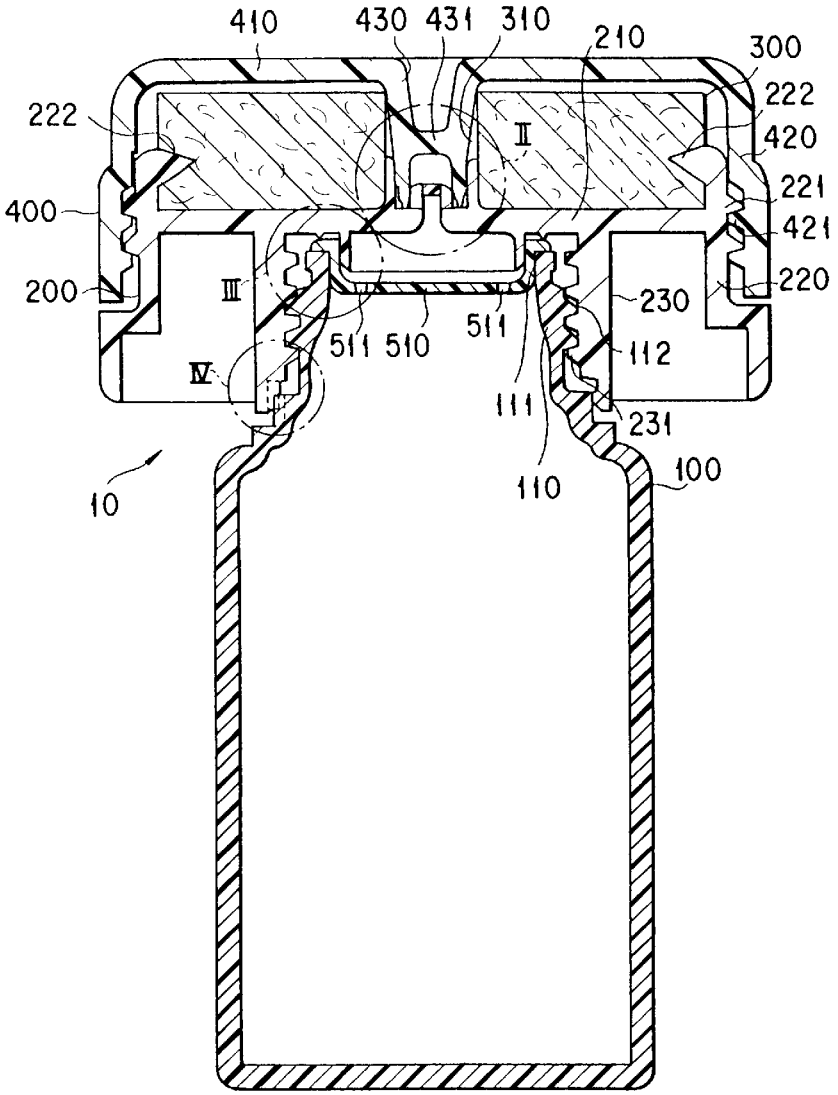
FIG. 1 is a cross-sectional view showing a major portion of a coating container according to a first embodiment of the present invention.
Figure 2:
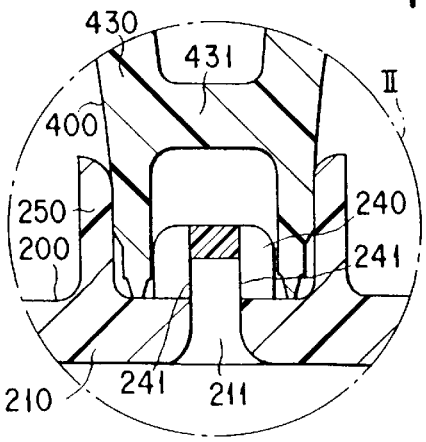
FIG. 2 is an enlarged cross-sectional view showing an area II in FIG. 1.

As shown in FIG. 1, a coating container 10 comprises a plastics container body 100 which is flexible and compressible, a plastics intermediate plug 500 having a through hole or holes 511, a plastics inner cap 200, a coating attachment 300 made of a felt, having a through hole 310 and held over the inner cap 200, and a plastics outer cap 400 having a sealing cylinder 430.

The intermediate plug 500 is fitted in an opening 111 of a neck portion 110 of the container body 100. The outer cap 400 is fitted over the inner cap 200.

The container body 100 has a bottom. The container body 100 is made of plastics, such as polyethylene, polypropylene or polyethyleneterephthalate and manufactured by a blow molding method or a stretched blow molding method.

Though not shown in FIG. 1, the container body 100 is preferably inclined at the neck portion 110 so that it can be easily handled in an upside down state in use.

A ratchet 114 is provided on a ring-like base seat section 113 at a lower side of an engaging section 112 on the neck portion 110 of the container body 100 and fitted in the inner cap 200.

The intermediate plug 500 is formed, by an injection molding method, of a thermoplastic resin, such as a low-density polyethylene.

The intermediate plug 500 includes an upright circumferential wall 520 along an outer periphery of a bottom plate 510 with a flange 530 formed at the upper end of the circumferential wall 520. Two through holes 511 are provided in the bottom plate 510 of the intermediate plug 500 near the circumferential wall 520. The through hole 511 may take various shapes and the number of the through holes 511 may be changed in accordance with the purpose for which the container is used.

The inner cap 200 is formed, by an injection molding method, of the thermoplastic resin, such as polypropylene or polyethylene and formed of a disk-shaped top plate 210 and circumferential wall 220 along the outer edge of the top plate 210.

The circumferential wall 220 of the inner cap 200 includes an engaging section 221 provided on the outer peripheral surface and adapted to engage with the outer cap 400 and a plurality of holding projections 222 provided at the top inside surface. The top plate 210 has a through hole 211 at its center and communicating with the container body 100 and an outlet cylinder 240 upwardly provided in communication with the through hole 211. The outlet cylinder 240 has its upper portion blocked. Outlet holes 241 are provided at the side wall of the outlet cylinder 240. The outlet holes 241 may take various shapes, and provided in proper numbers, for the purpose for which the coating container is used.

Figure 4:
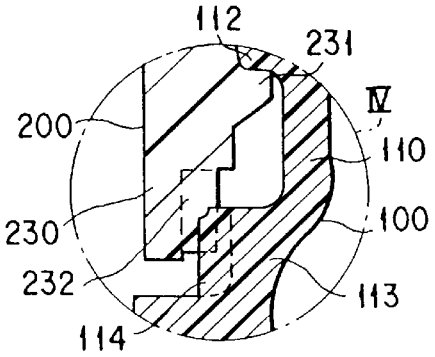
FIG. 4 is an enlarged cross-sectional view showing an area IV in FIG. 1.

A sealing ring 250 is provided on the upper surface of the top plate 210 at the outer periphery of the outlet cylinder 240 and closely fitted to the sealing plate 431 of the outer cap 400. An engaging cylinder 230 is provided on the lower surface of the top plate 210. The engaging cylinder 230 is constituted by an engaging section 231 provided at the inner wall surface and adapted to engage with the container body 100 and a ratchet 232 engaging with the container body 100 as more understandable from FIG. 4.

Figure 3:
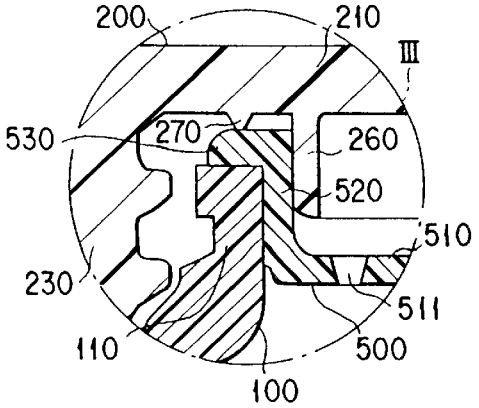
FIG. 3 is an enlarged cross-sectional view showing an area III is FIG. 1.

In the inner side of the engaging cylinder 230, a sealing projection 270 is provided for securing a close seal relative to the upper surface of the flange 530 of the intermediate plug 500 as more understandable from FIG. 3 and a sealing ring 260 is so provided as to be closely contacted with the inner wall surface of the intermediate plug 500.

A coating attachment 300 is constituted by a disk-shaped body with a through hole 310 at its center and made of a felt which is better in coating liquid's penetration and holing and in pliability and elasticity. The coating attachment 300 is easier to perform coating since the felt is used.

An outer cap 400 is formed, by an injection molding method, of a thermoplastic resin such as polypropylene and polyethylene. The outer cap 400 is constituted by a circumferential wall 420 and a top plate 410. On the inner wall surface of the circumferential wall 420 an engaging section 421 is provided so as to engage with the engaging section 221 of the inner cap 200. The outer cap 400 further includes a sealing cylinder 430 with a sealing plate 431 at its lower portion. The sealing cylinder 430 is inserted into the through hole 310 of the coating attachment 300.

The intermediate plug 500 is fitted in a neck portion 110 which is attached to an opening 111 of the container body 100 and the inner cap 200 is engaged with an engaging section 112 on the neck portion 110.

An outer cap 400 is fitted over the inner cap 200.

According to the first embodiment, the intermediate plug 500 is fitted in the neck portion 110 which is fitted in the opening 111 of the container body 100 and the lower outer peripheral surface of the sealing cylinder 430 of the outer cap 400 is closely fitted in the inner peripheral surface of the sealing ring 250 of the inner cap 200 which holds the coating attachment 300 at the upper surface of the top plate thereof. Therefore, it is possible to secure a close seal.

Further, since the lower edge portion of the sealing cylinder 430 of the outer cap 400 is closely contacted with the upper surface of the top plate 210 of the inner cap 200, the sealing characteristic can be improved.

When the coating container as shown in FIG. 1 is used, the outer cap 400 is removed from the coating container and the container body 100 is depressed. Due to the depression, a liquid in the container body 100 is flowed via the through hole 511 in the intermediate plug 500 and then via the through hole 211 in the inner cap 200 into the outlet cylinder 240. The liquid there is flowed from outlet holes 241 in the side wall of the outlet cylinder 240 into the through hole 310 in the coating attachment 300 after being pushed against the inner surface of the sealing ring 250 provided around the outer side of the outer peripheral surface of the outlet cylinder 240 of the inner cap 200. Then the liquid is penetrated into the coating attachment 300 and can be used in this liquid-penetrated state.

When, in this way, the liquid is penetrated into the coating attachment 300 by depressing the container body 100, the liquid is flowed from the outlet holes 241 in the side wall of the outlet cylinder 240 and is not flowed directly upward because the outlet cylinder 240 is blocked at an upper side. Therefore, the liquid is prevented from being scattered outwardly.

Since the liquid flowed from the outlet holes 241 is first blocked by the sealing ring 250 and then penetrated into the coating attachment 300, the liquid is further prevented from being scattered outwardly.

Other embodiments of the coating container according to the present invention will be described. The same portions as those of the first embodiment will be indicated in the same reference numerals and their detailed description will be omitted.

Figure 5:
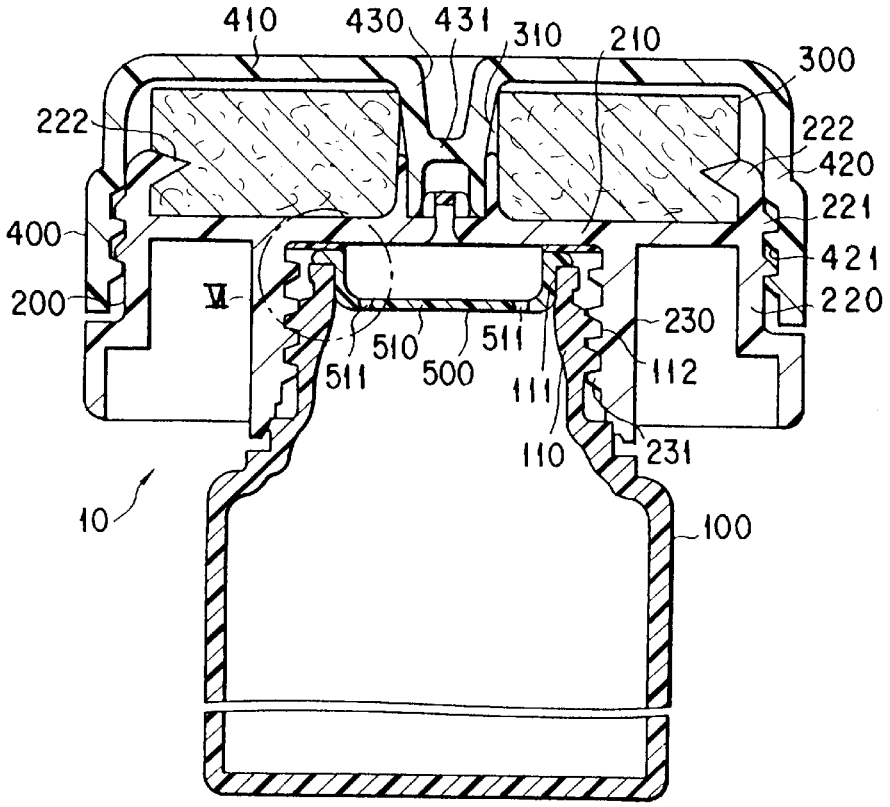
FIG. 5 is a cross-sectional view showing a major portion of a coating container according to a second embodiment of the present invention.
Figure 6:
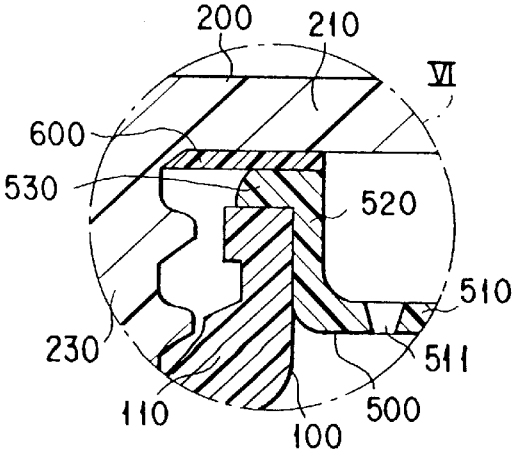
FIG. 6 is an enlarged cross-sectional view showing an area VI in FIG. 5.
Figure 7:
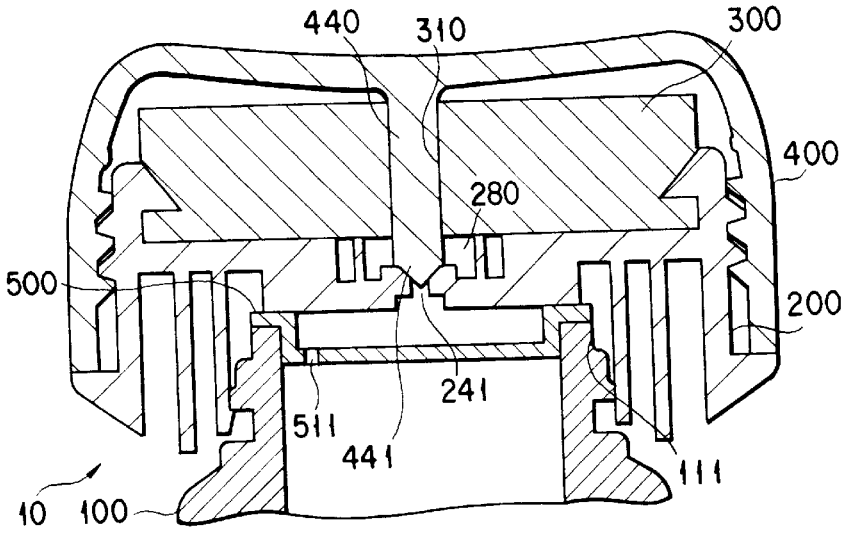
FIG. 7 (PRIOR ART)
FIG. 7 is a cross-sectional view showing a conventional coating container.
Figure 8:
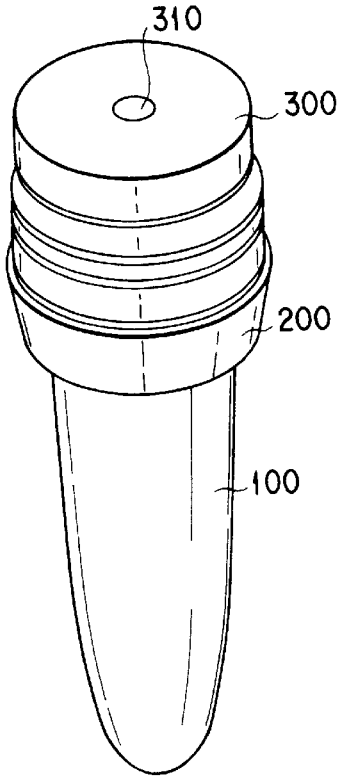
FIG. 8 (PRIOR ART)
FIG. 8 is a perspective view showing the container in FIG. 7 with an outer cap removed.

FIG. 5 is a cross-sectional view showing a major portion of a coating container according to a second embodiment of the present invention and FIG. 6 is an enlarged cross-sectional view showing an area VI in FIG. 5.

As shown in FIGS. 5 and 6, a packing 600 can be used so as to maintain a close seal between the inner cap 200 and the intermediate plug 500. In this embodiment, it is not necessary to provide the sealing ring 260 and sealing projection 270 shown in FIG. 3.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

I claim:

1. A coating container comprising:

a flexible container body made of plastics and capable of being depressed;

an intermediate plug having a through hole;

an inner cap;

a coating attachment made of a felt, having a through hole, and held over the inner cap; and an outer cap having a sealing cylinder, wherein said intermediate plug is fitted in an opening of a neck portion of the container body;

said outer cap is fitted over the inner cap;

said inner cap has a top plate with a through hole at a center area;

an outlet cylinder having a blocked upper surface and an outlet hole at a side wall is provided over the through hole;

a sealing ring is provided outside the outlet cylinder;

a circumferential wall is provided along an outer edge of the top plate;

said outer cap is comprised of a circumferential wall, a top plate, and the sealing cylinder inserted into the through hole in the coating attachment and having a sealing plate at a lower side; and a lower outer peripheral surface of the sealing cylinder of the outer cap is closely fitted in the sealing ring of the inner cap.

2. The coating container according to claim 1, wherein the lower end portion of the sealing cylinder of the outer cap is closely fitted on the upper surface of the top plate of the inner cap.

3. The coating container according to claim 1, wherein, a plurality of outlet holes are provided in the side wall of the outlet cylinder.

4. The coating container according to claim 1, wherein a sealing projection is provided under the lower surface of the top plate of the inner cap to be closely contact with the upper surface of a flange of the intermediate plug and a sealing ring is provided under the lower surface of the top plate of the inner cap to be close contact with the inner wall of the intermediate plug.

5. The coating container according to claim 1, wherein a packing is inserted between the top plate of the inner cap and the flange of the intermediate plug.

6. The coating container according to claim 1, wherein an engaging cylinder is provided under the top plate of the inner cap to engaged with the neck portion of the container body.

7. The coating container according to claim 6, wherein a first ratchet is provided at the lower end portion of the engaging cylinder to engage with the container body.

8. The coating container according to claim 7, wherein a second ratchet is provided on the container body in a position corresponding to the first ratchet of the engaging cylinder.

9. The coating container according to claim 1, wherein a plurality of holding projections are provided in an upper inner wall of the circumferential wall of the inner cap.

* * * * *